United States Patent [19]

Stol

[11] Patent Number: 4,511,296

[45] Date of Patent: Apr. 16, 1985

[54] ANCHOR BOLT WITH MECHANICAL KEYS DEPLOYED BY INTERNAL PRESSURIZATION

[75] Inventor: Israel Stol, Pittsburgh, Pa.

[73] Assignee: Invocas, Inc., Columbus, Ohio

[21] Appl. No.: 475,716

[22] Filed: Mar. 16, 1983

[51] Int. Cl.[3] ..... F16B 13/04; B23P 19/00

[52] U.S. Cl. ..... 411/20; 411/21; 411/82; 411/440; 405/259

[58] Field of Search ..... 411/19, 20, 21–23, 411/32, 33, 315–318, 347, 440, 356, 441; 405/259–261

[56] References Cited

U.S. PATENT DOCUMENTS

| | | | |
|---|---|---|---|
| 1,286,382 | 12/1918 | Mead . | |
| 1,400,401 | 12/1921 | Allan . | |
| 1,746,848 | 2/1930 | Bates . | |
| 2,042,401 | 5/1936 | Hult . | |
| 2,080,220 | 5/1937 | Butter et al. . | |
| 2,269,646 | 1/1942 | Burke . | |
| 2,342,732 | 2/1944 | Gudmundsen . | |
| 2,359,629 | 10/1944 | Dexter et al. . | |
| 2,378,118 | 6/1945 | Wildrich . | |
| 2,387,742 | 10/1945 | Burrows . | |
| 2,398,633 | 4/1946 | Gazda . | |
| 2,410,047 | 10/1946 | Burrows et al. . | |
| 2,421,769 | 6/1947 | Wolfe . | |
| 2,429,239 | 10/1947 | Rogers . | |
| 2,436,185 | 2/1948 | Torrensen . | |
| 2,438,976 | 4/1948 | Lautmann . | |
| 2,492,590 | 12/1949 | Nofzinger . | |
| 2,492,605 | 12/1949 | Varney et al. . | |
| 2,535,079 | 12/1950 | Lebert . | |
| 2,543,063 | 2/1951 | Rodgers . | |
| 2,556,465 | 6/1951 | Burrows et al. . | |
| 2,556,672 | 6/1951 | Bergh et al. . | |
| 2,562,724 | 7/1951 | Lebert . | |
| 2,573,880 | 11/1951 | Temple . | |
| 2,618,192 | 11/1952 | Temple . | |
| 2,618,399 | 11/1952 | Stratman et al. . | |
| 2,653,504 | 9/1953 | Smith . | |
| 2,779,279 | 1/1957 | Maiwurm . | |
| 2,807,184 | 9/1957 | Miller . | |
| 2,813,449 | 11/1957 | Barrett . | |
| 2,842,022 | 8/1958 | Semmion . | |
| 2,870,881 | 1/1959 | Rogge . | |
| 2,947,603 | 8/1960 | Teeple, Jr. . | |
| 2,956,469 | 10/1960 | Barbeau et al. . | |
| 2,960,902 | 11/1960 | De Caro . | |
| 2,977,837 | 4/1961 | Furini, Jr. . | |
| 2,978,796 | 4/1961 | Kemeny . | |
| 3,040,393 | 6/1962 | Dailey . | |
| 3,071,404 | 1/1963 | Van Hove | 411/440 |
| 3,101,859 | 8/1963 | Stoecker . | |
| 3,115,226 | 12/1963 | Thompson, Jr. . | |
| 3,119,298 | 1/1964 | Brown . | |
| 3,148,577 | 9/1964 | Parsons . | |
| 3,166,971 | 1/1965 | Stoecker . | |
| 3,167,122 | 1/1965 | Lang . | |
| 3,176,573 | 4/1965 | Dickie . | |
| 3,342,866 | 2/1967 | Jakosky . | |
| 3,962,837 | 6/1976 | Sero | 405/259 |
| 4,271,747 | 6/1981 | Bendler et al. | 411/20 |

FOREIGN PATENT DOCUMENTS

| | | | |
|---|---|---|---|
| 142925 | 11/1981 | Japan | 405/260 |

*Primary Examiner*—Thomas J. Holko
*Assistant Examiner*—Neill Wilson
*Attorney, Agent, or Firm*—Cushman, Darby & Cushman

[57] ABSTRACT

In order to provide an anchor site in a matrix of solid material which has an accessible face, a socket is formed in the material through the accessible face. A shaft such as an anchor bolt is inserted in the socket, leaving an accessible emergent outer end portion. Via the outer end, explosive force is introduced to or generated in a central cavity of the shaft, which explosive force dislodges and deploys radially essentially outwardly at least one key at at least one level within the socket. Various ways for producing the explosive force are described.

9 Claims, 13 Drawing Figures

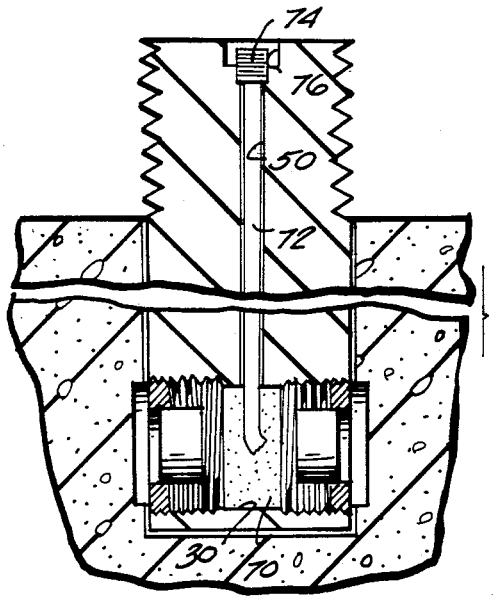
Fig. 4
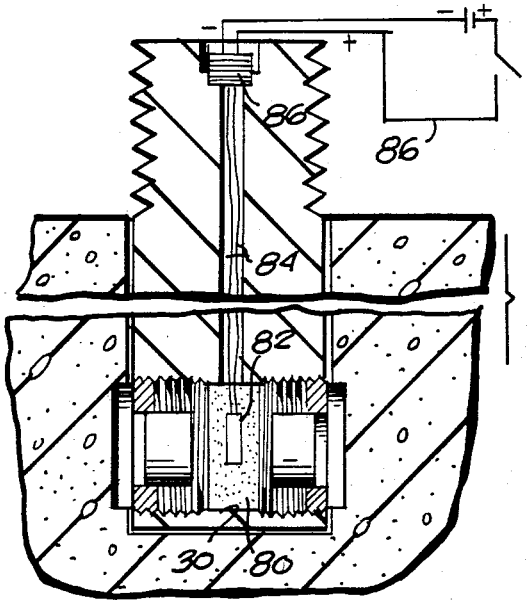
Fig. 5
Fig. 6
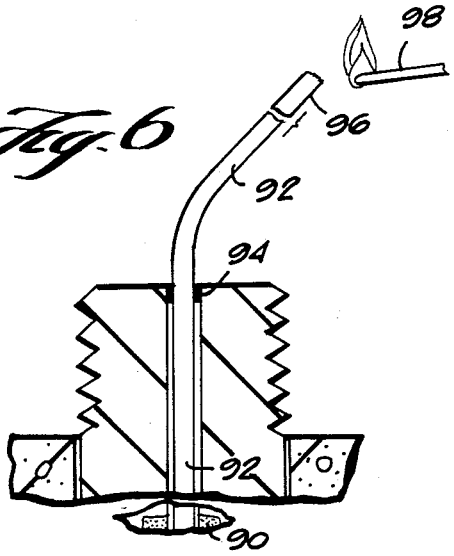
Fig. 7
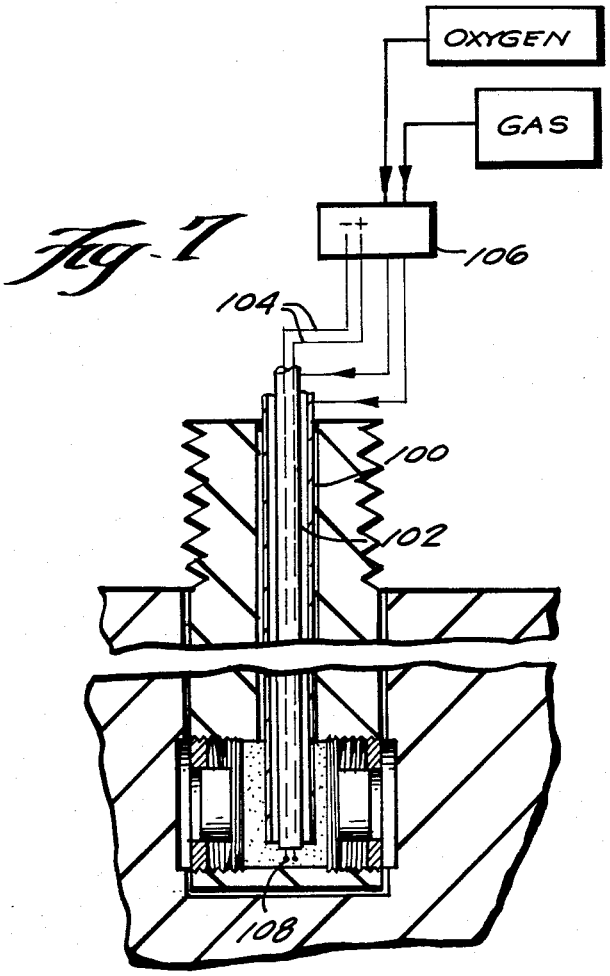
Fig. 8
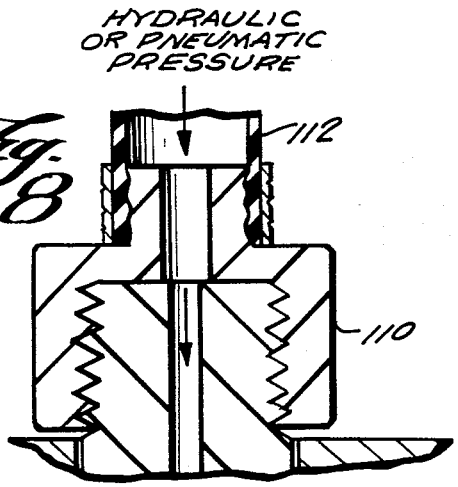

ANCHOR BOLT WITH MECHANICAL KEYS DEPLOYED BY INTERNAL PRESSURIZATION

BACKGROUND OF THE INVENTION

Many anchor bolts which utilize an expansion feature are effectively useful only with hollow walls, because the expanding feature is designed to undergo a compound movement during deployment, i.e. to pivot outwards and axially toward the bolt head.

Other expansion-type anchor bolts meant for use within the matrix of a solid material such as concrete, rock, coal and the like rely for anchoring on a jam fit produced by radial expansion of the anchor bolt, accompanied by corresponding axial shortening after the anchor bolt has been inserted in a socket in the matrix.

In other instances expansion requires a deformation of a tubular portion of the bolt and/or of a bolt jacket portion. This effectively rules out the use as bolt-fabricating material of strong, hard metals which happen to be too brittle to be successfully deformed in the expansion process.

For constructing anchor bolts of strong, hard metals for use in matrices of solid material such as rock, concrete and coal, a classical solution has been to bore or otherwise form a considerably oversize socket, to insert the anchor bolt in the oversize socket with its anchors already fully and often fixedly deployed, and then to cement-fill excess volume of space around the anchor bolt in the socket, e.g. using metal-filled epoxy resin, an epoxy-laced mortar, or the like.

SUMMARY OF THE INVENTION

In order to provide an anchor site in a matrix of solid material which has an accessible face, a socket is formed in the material through the accessible face. A shaft such as an anchor bolt is inserted in the socket, leaving an accessible emergent outer end portion. Via the outer end, explosive force is introduced to or generated in a central cavity of the shaft, which explosive force dislodges and deploys radially essentially outwardly at least one key at at least one level within the socket. Various ways for producing the explosive force are described.

The principles of the invention will be further discussed with reference to the drawing wherein preferred embodiments are shown. The specifics illustrated in the drawing are intended to exemplify, rather than limit, aspects of the invention as defined in the claims.

BRIEF DESCRIPTION OF THE DRAWING FIGURES

Figure 2:
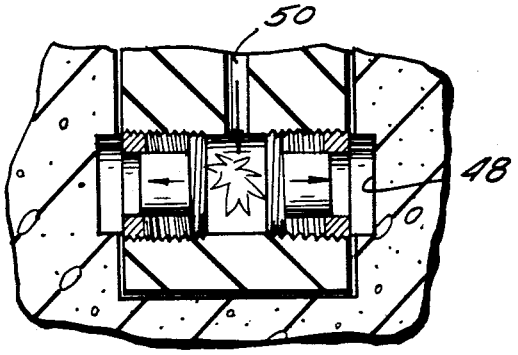
FIG. 2 is a fragmentary longitudinal sectional view of a modified use of the device of FIG. 1 wherein, as a preliminary measure, the socket has been provided with a milled undercut to receive the radially outwardly projecting keys. The stage depicted in FIG. 2 is equivalent to the stage depicted in FIG. 1.
Figure 3:
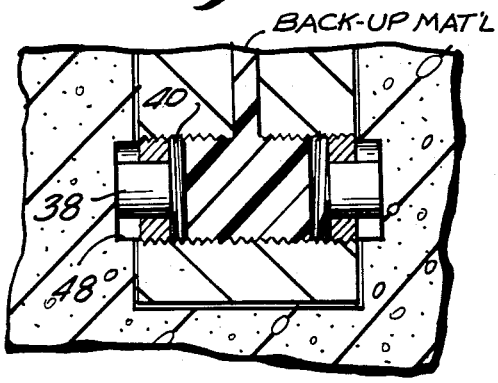
FIG. 3 is a fragmentary longitudinal sectional view similar to FIG. 2, but showing a later stage wherein the keys have been projected radially beyond the profile of the bolt shank into the matrix, and the volume of the internal cavity of the anchor bolt has been filled with a settable composition, such as caulking or metal-filled epoxy resin.

FIGS. 4–13 are respective longitudinal sectional views or fragmentary longitudinal sectional views of an anchor bolt depicting various ways and means for producing the burst of atmospheric pressure needed for radially outwardly thrusting the keys. In these views, the cutting plane passes between angularly adjacent keys, so that no keys are shown in these views. However, it will be understood that in each instance, key arrangements such as are shown in FIGS. 1–3 are present in each of these embodiments.

DETAILED DESCRIPTION

Figure 1:
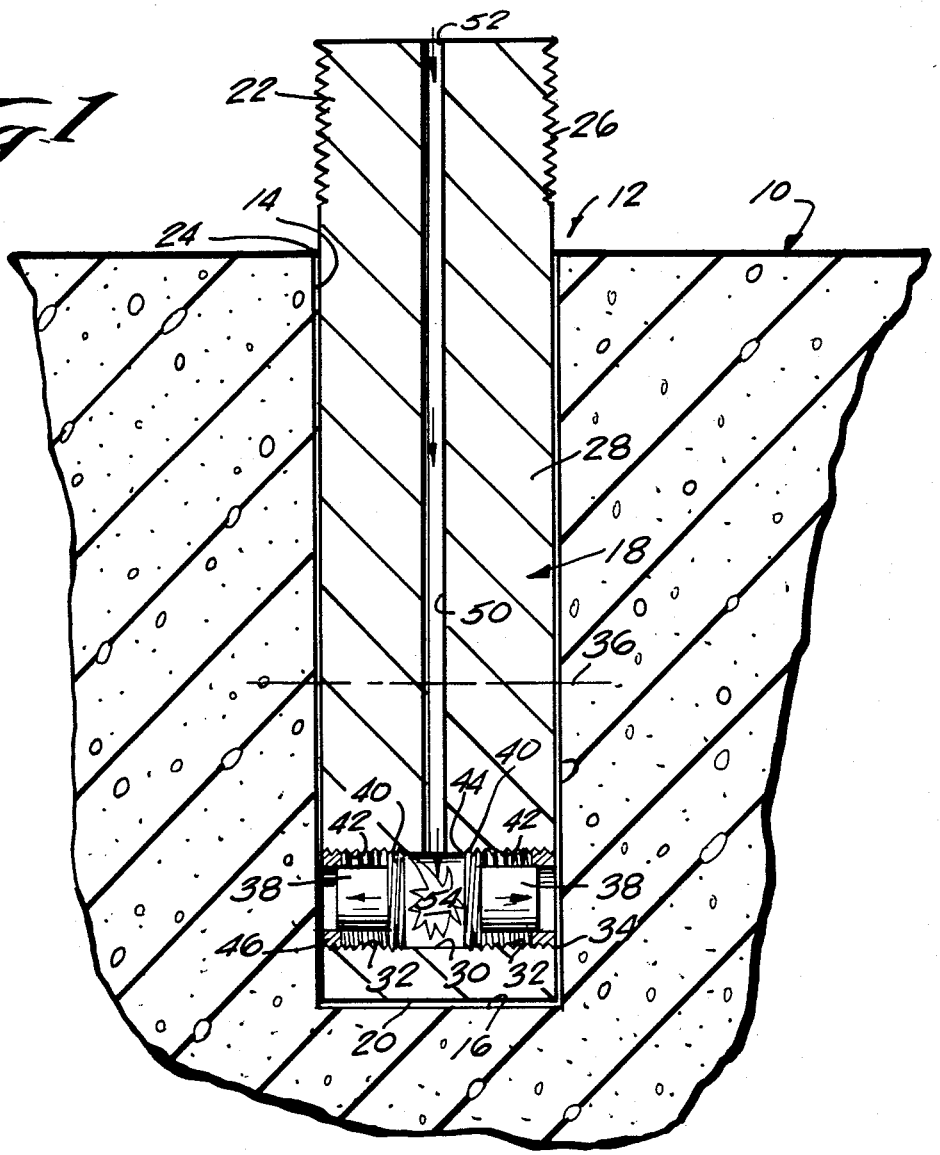
FIG. 1 is a longitudinal sectional view of a socket in a matrix of solid material with an anchor bolt embodying principles of the present invention received therein. At the moment depicted, a surge of superatmospheric pressure in an internal cavity centrally located behind the keys is about to radially outwardly deploy the keys into the matrix.

FIG. 1 shows a matrix of solid material 10 such as rock, earth, concrete, steel, coal or the like in which a socket 12 of generally cylindrical form has been conventionally provided e.g. by boring, molding, melting or the like.

In the socket 12, which has a sidewall 14 and a bottom wall 16 there is shown snuggly received an anchor bolt 18 in the form of a generally cylindrical shaft having an inner end 20 which may be seated on the bottom wall 16 of the socket, and having a stub portion 22 which emerges from and extends out of the mouth 24 of the socket. This stub portion typically is provided with some sort of surface means by which something else may be connected to the anchor bolt once the anchor bolt has been fixed in the socket 12. In the instance depicted, the connection-providing surface means is typified by a band of external threading 26 on the stub 22. However, other equivalent means such as an eye or a barb could be provided as the connection-providing surface means.

Accordingly, the portion 28 of the anchor bolt shaft disposed axially adjacent the stub portion 22 lies embedded in the matrix 10. At at least one level above the inner end 20, the embedded portion of the anchor bolt shaft is provided with a central cavity 30 having at least one radially outwardly directed passageway 32 which extends to the outer periphery of the anchor bolt shaft, where it has a mouth 34. In the instance depicted, there is one cavity 30; if a second one were to be provided, it and the associated structures would be replicated, e.g. at the level of the chain-dot line 36 in FIG. 1. Also in the instance depicted, the cavity 30 has two radial passageways 32 which are shown being angularly separated by 180°. In other words, they are shown being diametrically opposed. In practice fewer (e.g. one) or more (e.g. 3, 4, 5 or 6 or more) passageways 32 could be provided, typically with equal angular spacing among them.

Each radially directed passageway is shown receiving a key 38, e.g. in the form of a cylindrically shaped body of hard metal, which may have a gasket/ratchet collar 40 provided at or near its trailing end. Likewise, at least a portion of each radially directed passageway 32 may be internally threaded or otherwise provided with a ratchet surface as at 42. In the instance depicted, the collars 40 have initially been seated against the respective shoulders 44 which are provided at the radially inner ends of the bands of ratchet threading 42. Further, annular outer stop collars 46 have been threaded into the radially outer ends of the passageways 32. These members, as shown also serve as bearings for the radially outer nose portions of the keys 38.

In the preferred embodiments as shown, the outer periphery of the embedded portion of the anchor bolt shaft, prior to radially outward thrusting of the keys 38, is generally cylindrical, although it may be externally threaded so as to be snuggly socketed in part by threadedly turning it into the socket.

If desired, the outer ends of the passageways 32 may be closed-off at the time of manufacture using a thin wrapping of pressure-sensitive adhesive-backed waterproof tape, e,g. for the purpose of keeping moisture out of the passageways 32 and central cavity 30. If the tape has any appreciable or significant bursting strength, instructions for use of the device 18 should make it clear that such tape is to be removed before the device 18 is socketed. Coverings having low bursting strength, on the other hand, may simply be left in place, since they will not deter radially outward thrusting of the keys 38.

In FIG. 1, the socket sidewall is shown being generally smoothly cylindrically curved and of a generally constant diameter. This configuration is adequate for instances where the material 10 is sufficiently soft or compressible that when the keys 38 are shot outwards they will appreciably dent into or otherwise invade the space now shown as occupied by the material 10. For instances where such an invasion cannot be counted upon, the socket sidewall may have a radially inwardly opening groove 48 formed therein (FIG. 2) prior to insertion of the anchor bolt shaft. The groove 48 may be conventionally cut using an underreamer or similar milling tool or the like.

As shown, a longitudinal passageway 50 enters the stub of the anchor bolt shaft at 52, typically centrally through the outer end of the anchor bolt shaft, and extends longitudinally within the stub and embedded portion, to intersection with the central cavity 30 (or with each central cavity 30 where there are more than one).

In order to radially outwardly thrust the keys 38 into engaging relation with the matrix 10, as shown in FIG. 3, it is necessary to cause a sudden surge 54 of superatmospheric pressure in the or each central cavity 30, generally by sending a signal or an initiation or a surge of pressure along the longitudinal passageway from 52 to 30 as indicated by the arrows 54. Several ways and means for providing such a sudden surge of superatmospheric pressure are described hereinbelow with reference to FIGS. 4–13.

As the keys 38 are thrust radially outwards into intefering if not penetrating relation with the matrix 10 as illustrated in FIG. 3, the collars 40 are forced past the ratchet surfaces 42. Radial outward travel may be limited by engagement of the collars 40 with the stop rings 46, thus avoiding complete projection of the keys 38 out of the radially directed passageways 32 and preventing such rebound as would leave any of the keys 38 in an ineffective, radially retracted condition.

In FIG. 3, where the anchor bolt is depicted in an anchored state, the resultingly expanded internal cavity 30 is shown filled with a set, originally fluid back-up material such as caulking or metal-filled epoxy resin. Such material may be pumped in through the longitudinal passageway 50, and can serve to strengthen the anchor and to prevent accidental loosening or retraction of the keys, and for reducing corrosion by keeping air, saltwater and the like out of the filled volume.

Exemplary ways and means for providing the burst of pressure indicated at 54 will now be described.

Referring first to FIG. 4, an embodiment is depicted wherein each cavity 30, in manufacturing or loading the anchor bolt 18, is filled with conventional explosive powder, such as fast burning gunpowder 70, and a primer cord 72 in contact with the bulk of the explosive powder 70 leads up the longitudinal passageway 50, to the mouth, where a percussive cap 74 is provided thereon, preferably in a recess 76 so as to minimize the chance of accidental striking. Accordingly, in order to produce the sudden burst of pressure 54 in each cavity 30, the cap 74 is struck by an appropriate hammer, whereupon the primer cord 72 is ignited and burns its way to the explosive powder 70 which then explodes, producing the sudden burst of pressure.

Referring next to FIG. 5, an embodiment is depicted wherein each cavity 30, in manufacturing or loading the anchor bolt 18, is filled with conventional explosive powder 80, in which is embedded an electrically ignited primer 82, the electrically insulated lead wires 84 of which pass up out of the passageway 50 at 52 through a backpressure plug 86 made of dielectric material. Outside the anchor bolt 18, the lead wires 84 may be connected in a conventional detonation circuit 86, e.g. including a power source such as a battery and a switch.

A further embodiment is shown in FIG. 6, where the explosive powder 90 has a primer cord 92 embedded in it, and leading up and out of the passageway 50. An annular plug 94 is shown provided about the primer cord 92 at the mouth 52 of the passageway 50. Accordingly, to produce the burst of pressure 54, the emergent segment 96 of the primer cord 92 may be lit with a match 98.

In the embodiment shown in FIG. 7, an explosively combustible gas mixture is formed in each chamber 30, e.g. by introducing acetylene and oxygen through respective concentric pipes 100, 102, and using lead wires 104 from a high voltage source 106 to produce an ignition spark at 108.

In the embodiment depicted in FIG. 8, the burst of pressure 54 is produced by threading onto the stub of the anchor bolt a nut 110 to which a high pressure hose 112 is connected. The hose 112 is connected to a valved supply of highly pressurized fluid, such as air, water, caulking compound or settable epoxy resin. When the time arrives for thrusting the anchor keys 38 by producing a sudden overpressure at 30, the valve to the line 112 is temporarily opened. Thereafter, the nut 110 may be removed from the stub of the anchor bolt. Even if the anchor keys 38 are thrust by some other means, such as the explosive means heretofore described, the equipment depicted in FIG. 8 may be used for backing-up the keys with a settable composition as described hereinabove with reference to FIG. 3.

Figure 9:
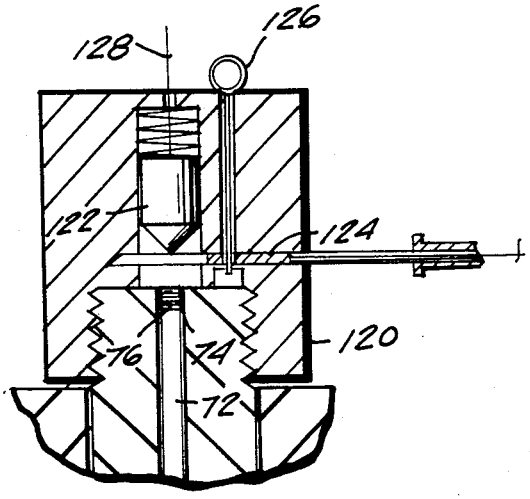

FIG. 9 shows a variation of the embodiment shown in FIG. 4. A nut 120 is shown temporarily threaded onto the stub of the anchor bolt which has been provided with an explosive charge 70, primer cord 72 and a percussion cap 74 seated in a recess 76. The nut 120 contains a spring loaded firing pin 122 poised over the cap 74 and maintained in a loaded condition by a lateral slide plate 124, which may be kept from being prematurely slid out of place, by a safety pin 126. A cable 128 is provided for reloading the hammer for the next anchor bolt key-thrusting process.

Figure 10:
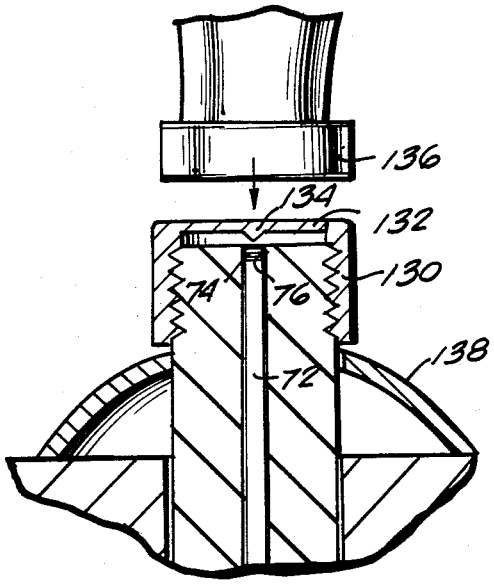

FIG. 10 also shows a variation of the embodiment shown in FIG. 4. A nut 130 is shown temporarily threaded onto the stub of the anchor bolt which has been provided with an explosive charge (not shown), primer cord 72 and a percussion cap 74 seated in a recess 76. The nut 130 has an endwall 132 having a central protuberance 134 provided on its underside. The protuberance 134 is poised over the percussion cap 74. For exploding the powder to produce the desired sudden overpressure, the endwall of the nut 130 is simply struck with a hammer 136, impacting the protuberance 134 against the percussion cap 74. A dome-like shrapnel shield 138 is shown temporarily fitted about the anchor bolt stub and against the outer face of the body of material 10. This device may be used on the anchor bolt in connection with this and any of the embodiments described herein.

Figure 11:
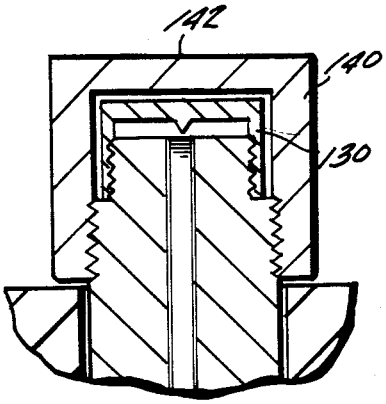

An elaboration of what is shown in FIG. 10 is shown in FIG. 11. Here a further safety cap 140 is threaded onto the stub of the anchor bolt over the top of the nut 130. The endwall 142 of the safety cap 140 is sufficiently massive and stiff that were the so-protected anchor bolt accidently dropped on its head, or prematurely hit with a hammer, the protuberance 134 would not be driven into the percussion cap 74.

Figure 12:
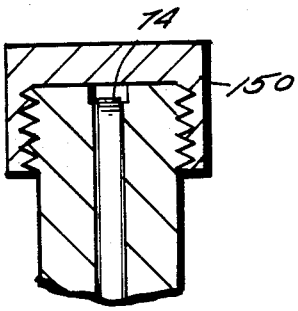

In FIG. 12, a safety cap 150 has been temporarily threaded onto the stub end of the anchor bolt to protect the percussion cap 74 from being prematurely struck.

Figure 13:
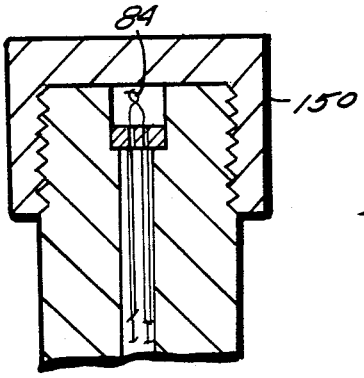

FIG. 13, a safety cap 150 has been temporarily threaded onto the stub end of the anchor bolt to protect the electric leads 84 of the embodiment shown in FIG. 5 from being prematurely connected to an electric power source. The leads 84 are shown temporarily twisted together under the cap to prevent the possibility of an electrostatic charge from building up between them.

It should now be apparent that the anchor bolt with mechanical keys deployed by internal pressurization as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. An anchor bolt for providing an anchor site in a matrix of solid material which has an accessible face having a generally cylindrical socket formed therein through said accessible face, said anchor bolt comprising:

a shaft constructed and arranged to be snuggly received one end first into the socket so as to have an axially inner portion embedded in the matrix and an axially outer stub portion protruding outwardly of said accessible face;

means defining at least one cavity generally centrally within the axially inner portion of the shaft;

means defining a longitudinally extending passageway in said shaft, said longitudinal passageway extending from communication with said cavity, to the exterior of said stub portion of said shaft;

at least one respective radially extending passageway extending in said shaft between each said cavity and the exterior of said shaft axially inner portion;

a key of hard, durable material wholly recessed in each said radially extending passageway, each such key, said at least one cavity and said passageways being constructed and arranged for direct exposure of each such key to superatmospheric fluid pressure when applied to said at least one cavity, and being constructed and arranged for direct, engaging penetration of said matrix upon being driven radially outwardly; and means, operable via said longitudinal passageway, for producing such a surge of superatmospheric fluid pressure in each said cavity, that each said key is driven radially outwardly in the respective radially extending passageway to a position of partial-length protrusion radially from said shaft, so that the anchor bolt may be firmly locked in the socket in which its axially inner end portion is received.

2. The anchor bolt of claim 1, wherein: the means for producing a surge of superatmospheric pressure is constituted by means of producing a chemical explosion in said cavity.

3. The anchor bolt of claim 2, wherein:

said means for producing a chemical explosion includes a quantum of explosive powder, a primer cord leading therefrom through said longitudinal passageway, and means for initiating burning of said primer cord.

4. The anchor bolt of claim 3, wherein:

said initiating means is constituted by a percussion cap connected with said primer cord and mounted on the stub portion of said shaft.

5. The anchor bolt of claim 3, wherein:

said initiating means is constituted by an emergent length of said primer cord which is subject to being lit from outside of said stub portion of said shaft.

6. The anchor bolt of claim 2, wherein:

said means for producing a chemical explosion includes a quantum of explosive powder, a set of electric leads leading from an initiator in contact with the explosive powder, through said longitudinal passageway to outside the stub portion of the shaft, and switched electric power source means connected in circuit with said electric leads.

7. The anchor bolt of claim 2, wherein:

said means for producing a chemical explosion includes piping means for introducing an explosive gas mixture to each said cavity through said longitudinal passageway;

electric leads passing into each said cavity through said longitudinal passageway and having means defining a spark gap in each said cavity; and a switched source of electric power connected with said electric leads.

8. The anchor bolt of claim 1, wherein:

the means for producing a surge of superatmospheric pressure is constituted by a valved source of pressurized fluid located outside said shaft; and conduit means for communicating said source of pressurized fluid to said longitudinal passageway.

9. The anchor bolt of claim 8, wherein:

said source of pressurized fluid is constituted by a source of pressurized settable adhesive compound.

* * * * *